US009622626B1

(12) United States Patent
Radke

(10) Patent No.: US 9,622,626 B1
(45) Date of Patent: Apr. 18, 2017

(54) PAPER TOWEL HOLDER CLAMP

(71) Applicant: Russell Radke, Ocala, FL (US)

(72) Inventor: Russell Radke, Ocala, FL (US)

( * ) Notice: Subject to any disclaimer, the term of this patent is extended or adjusted under 35 U.S.C. 154(b) by 310 days.

(21) Appl. No.: 14/525,641

(22) Filed: Oct. 28, 2014

(51) Int. Cl.
*B65H 75/40* (2006.01)
*A47K 10/38* (2006.01)
*A47K 10/22* (2006.01)

(52) U.S. Cl.
CPC ..... *A47K 10/3836* (2013.01); *A47K 10/22* (2013.01)

(58) Field of Classification Search
CPC ... A47K 10/22; A47K 10/3836; B65H 75/446
See application file for complete search history.

(56) References Cited

U.S. PATENT DOCUMENTS 30,867 A * 12/1860 Benedict ..... B65H 49/30 242/404.1
1,570,358 A 1/1926 Levine
1,656,464 A 1/1929 Auren
3,721,395 A * 3/1973 Snipes ..... B60R 7/084 242/134
4,741,486 A * 5/1988 Ancona ..... A47K 10/3836 242/597.4
5,167,377 A * 12/1992 Chalmers ..... A47F 13/085 119/161
5,218,779 A * 6/1993 Morgan ..... A01K 89/003 242/423.2
5,297,749 A 3/1994 White
5,692,639 A 12/1997 Lahaussois
6,231,000 B1 * 5/2001 Wood ..... A47K 10/3836 242/597.7
2,554,812 A1 11/2009 Durham
2013/0112802 A1 5/2013 Griggs

FOREIGN PATENT DOCUMENTS

WO WO2012146300 11/2012

* cited by examiner

*Primary Examiner* — William A Rivera
(74) *Attorney, Agent, or Firm* — Kyle A. Fletcher, Esq.

(57) ABSTRACT

The clip assembly includes a tube that has a top end and a bottom end. A first disk is coupled to the tube. The first disk is positioned proximate the bottom end of the tube. A second disk is removably coupled to the top end of the tube. The roll of paper towels is inserted onto the tube. The roll of paper towels is retained between the first and second disks. A clamp is coupled to the bottom end of the tube. The clamp selectively engages the object. The tube is retained on the object.

17 Claims, 4 Drawing Sheets

PAPER TOWEL HOLDER CLAMP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of holder clamps, more specifically, paper towel holder clamps.

SUMMARY OF THE INVENTION

An embodiment of the disclosure meets the needs presented above by generally comprising a tube that has a top end and a bottom end. A first disk is coupled to the tube. The first disk is positioned proximate the bottom end of the tube. A second disk is removably coupled to the top end of the tube. The roll of paper towels is inserted onto the tube. The roll of paper towels is retained between the first and second disks. A clamp is coupled to the bottom end of the tube. The clamp selectively engages the object. The tube is retained on the object.

An object of the invention is to provide a device that is paper towel holder clamp.

These together with additional objects, features and advantages of the paper towel holder clamp will be readily apparent to those of ordinary skill in the art upon reading the following detailed description of presently preferred, but nonetheless illustrative, embodiments of the paper towel holder clamp when taken in conjunction with the accompanying drawings.

In this respect, before explaining the current embodiments of the paper towel holder clamp in detail, it is to be understood that the paper towel holder clamp is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the paper towel holder clamp.

It is therefore important that the claims be regarded as including such equivalent construction insofar as they do not depart from the spirit and scope of the paper towel holder clamp. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

Figure 1:
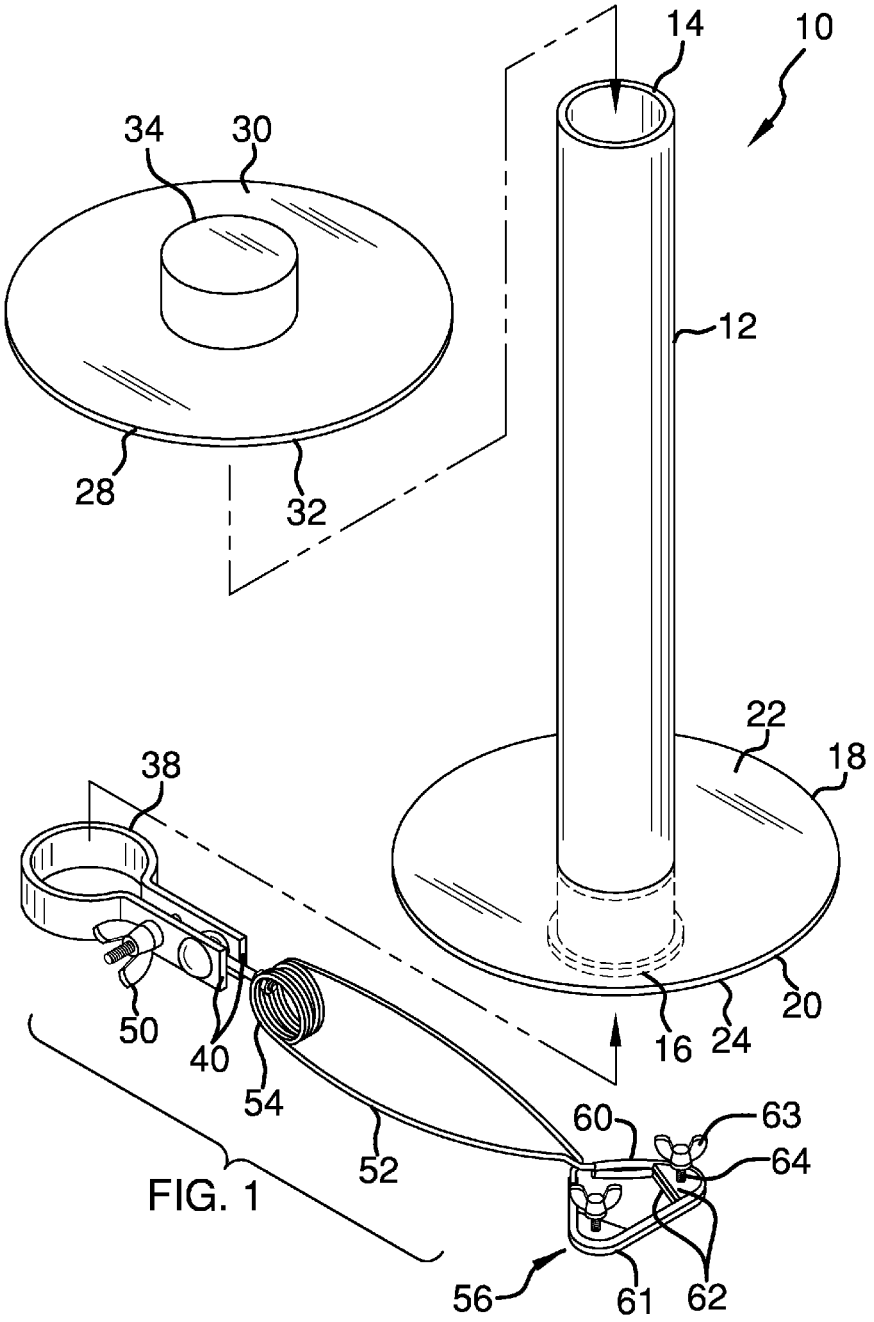
FIG. 1 is a perspective view of a clip assembly according to an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 4, the clip assembly 10 generally comprises a tube 12 that has a top end 14 and a bottom end 16. The tube 12 is elongated. Additionally, the tube 12 may have a length between 25 cm and 30 cm.

A first disk 18 is provided. The first disk 18 has an outer edge 20 extending between a top side 22 and a bottom side 24 of the first disk 18. The bottom end 16 of the tube 12 extends through the top 22 and bottom 24 sides of the first disk 18. Additionally, the first disk 18 is positioned proximate the bottom end 16 of the tube 12.

A second disk 26 is provided. The second disk 26 has an exterior edge 28 extending between an upper side 30 and a lower side 32 of the second disk 26. A cap 34 is coupled to the upper side 30 of the second disk 26. The top end 14 of the tube 12 extends through the lower 32 and upper 30 sides of the second disk 26 and engages the cap 34.

A roll of paper towels 36 is insertable onto the tube 12. The roll of paper towels 36 is retained between the first 18 and second 26 disks. The roll of paper towels 36 may be of any conventional design.

A mount 38 is provided. The mount 38 has a pair of ends 40. Additionally, the mount 38 is curved. Each of the pair of ends 40 of the mount 38 is positioned adjacent to one another. The mount 38 forms an open loop. Moreover, the mount 38 is positionable around the tube 12 proximate the bottom end 16 of the tube 12.

A swivel 42 has a first end 44 and a second end 46. A ball 48 is coupled to the first end 44 of the swivel 42. The ball 48 is positioned between each of the pair of ends 40 of the mount 38. The swivel 42 is movably coupled to the mount 38.

A fastener 50 extends laterally through the mount 38 proximate each of the pair of ends 40 of the mount 38. The fastener 50 tightens each of the pair of ends 40 of the mount 38 around the ball 48. Finally, the fastener 50 may be a nut and bolt of any conventional design.

A clamp 52 is provided. The clamp 52 has a coupled end 54 and a free end 56. The coupled end 54 of the clamp 52 is coupled to the second end 46 of the swivel 42.

The clamp 52 is positionable at a selected angle with respect to the tube 12. The clamp 52 selectively engaging an object 58. The tube 12 is retained on the object 58. Finally, the clamp 52 may be a spring clamp of any conventional design.

In use, the roll of paper towels 36 is positioned around the tube 12. The second disk 26 is coupled to the tube 12. The clamp 52 is clamped to the object 58. The clamp 52 is positioned at the selected angle with respect to the tube 12 and the fastener 50 is tightened to retain the clamp 52 at the selected angle.

The free end 56 of the clamp 52 may be further defined with a top, free end 60 and a bottom, free end 61. The top, free end 60 extends away from the bottom, free end 61 in order for the object 58 to slide there between. The top, free end 60 and the bottom, free end 61 may be secured to one another via corner plates 62 provided therein. A wing nut 63 and bolt 64 may be used to tighten the top, free end 60 to the bottom, free end 61.

Figure 2:
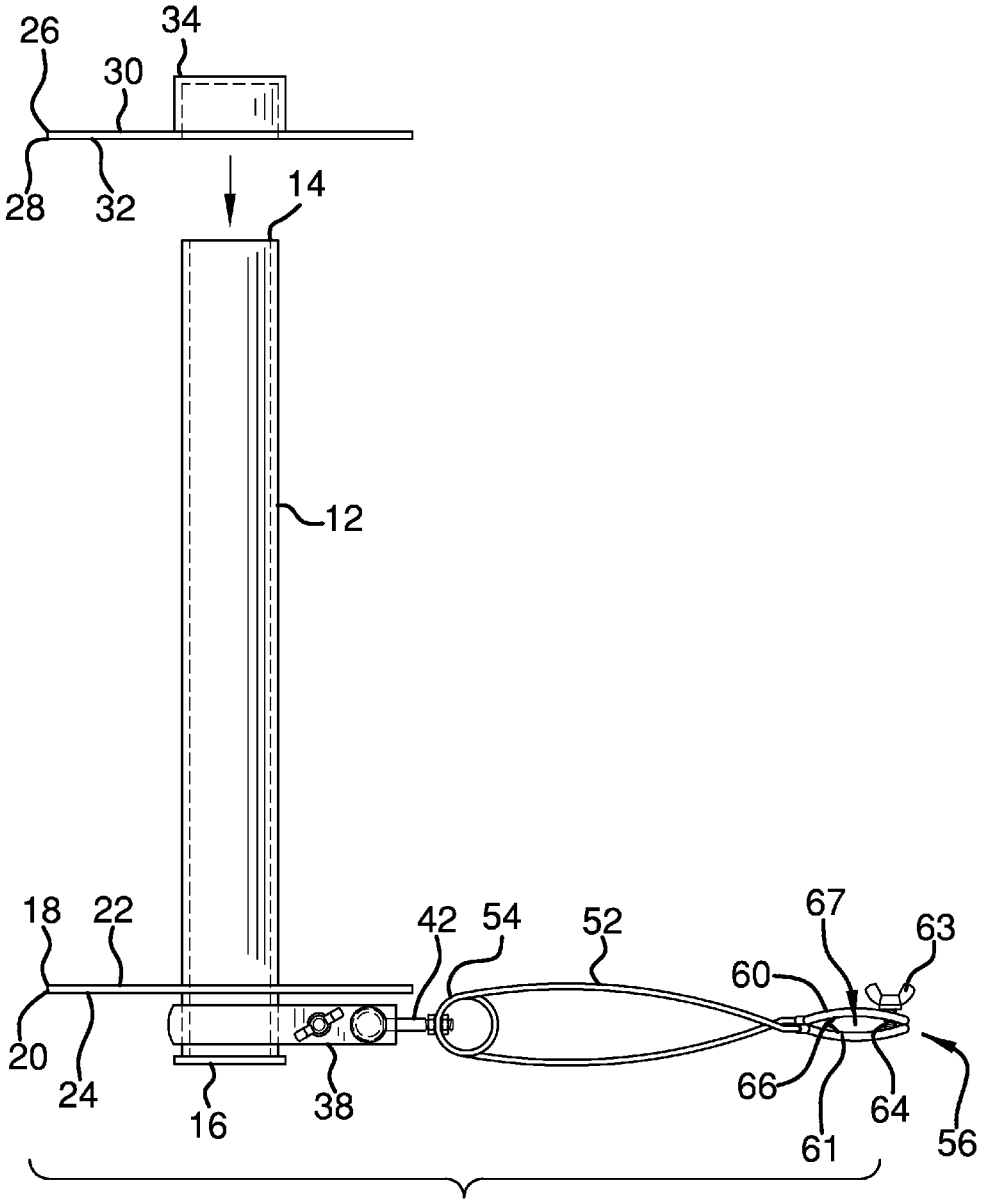
FIG. 2 is a left side view of an embodiment of the disclosure.
Figure 3:
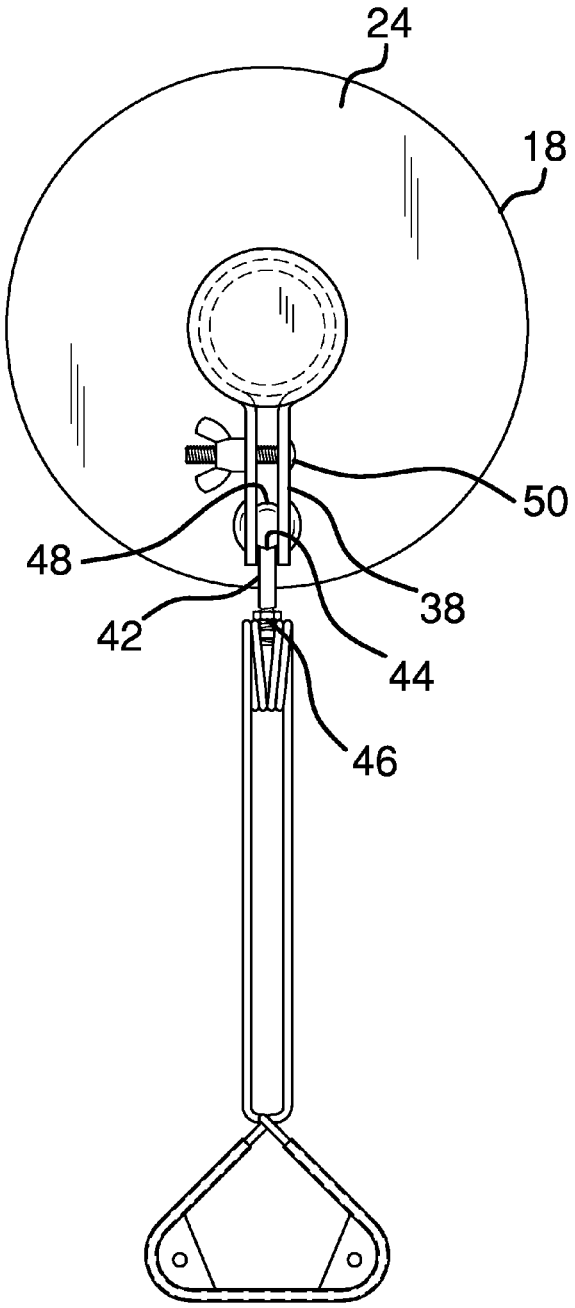
FIG. 3 is a bottom view of an embodiment of the disclosure.
Figure 4:
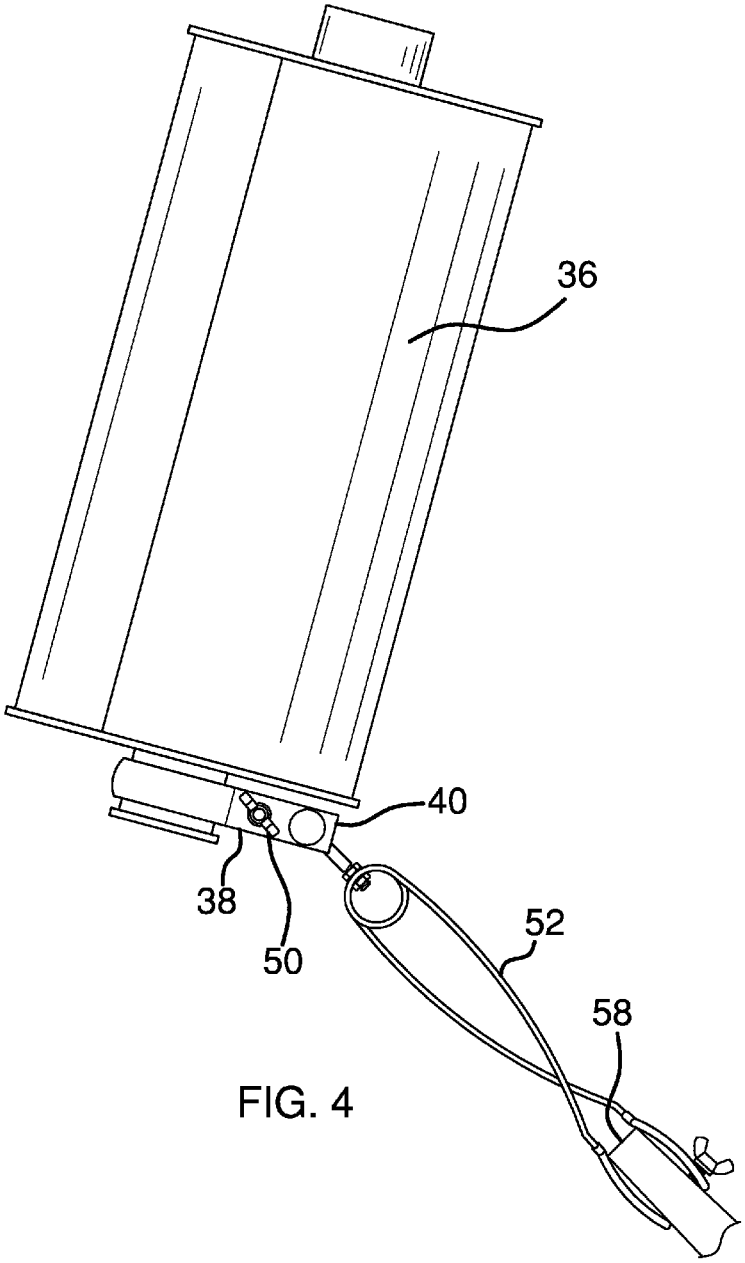
FIG. 4 is an in-use view of an embodiment of the disclosure.

Referring to FIG. 2, both the top, free end 60 and the bottom, free end 61 include a bend 66 that forms a gap 67 between the top, free end 60 and the bottom, free end 61. The gap 67 provides for a more adaptive clamp 52 with respect to the object 58.

With respect to the above description, it is to be realized that the optimum dimensional relationship for the various components of the clip assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the clip assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A clip assembly configured to retain a roll of paper towels on an object, said assembly comprising:

a tube having a top end and a bottom end;

a first disk coupled to said tube, said first disk being positioned proximate said bottom end of said tube;

a second disk removably coupled to said top end of said tube, the roll of paper towels being inserted onto said tube such that the roll of paper towels is retained between said first and second disks;

a clamp coupled to said bottom end of said tube, said clamp selectively engaging the object such that said tube is retained on the object;

wherein a mount having a pair of ends;

wherein said mount being curved such that each of said pair of ends of said mount is positioned adjacent to one another, said mount forming an open loop.

2. The assembly according to claim 1, wherein said tube being elongated.

3. The assembly according to claim 1, wherein said first disk having an outer edge extending between a top side and a bottom side of said disk.

4. The assembly according to claim 3, wherein said bottom end of said tube extending through said top and bottom sides of said first disk.

5. The assembly according to claim 1, wherein said second disk having an exterior edge extending between an upper side and a lower side of said second disk.

6. The assembly according to claim 5, wherein a cap coupled to said upper side of said second disk.

7. The assembly according to claim 6, wherein said top end of said tube extending through said lower and upper sides of said disk and engaging said cap.

8. The assembly according to claim 1, wherein said mount being positionable around said tube proximate said bottom end of said tube.

9. The assembly according to claim 1, wherein a swivel having a first end and a second end; a ball coupled to said first end of said swivel; said ball being positioned between each of a pair of opposite ends of a mount such that said swivel is movably coupled to said mount.

10. The assembly according to claim 1, wherein said clamp having a coupled end and a free end; wherein said coupled end of said clamp being coupled to a second end of a swivel.

11. The assembly according to claim 10, wherein said clamp being positionable at a selected angle with respect to said tube.

12. The assembly according to claim 11, wherein the free end of the clamp is further defined with a top, free end and a bottom, free end; wherein the top, free end extends away from the bottom, free end in order for the object to slide there between; wherein the top, free end and the bottom, free end are secured to one another via corner plates provided therein; wherein a wing nut and bolt is used to tighten the top, free end to the bottom, free end.

13. The assembly according to claim 12, wherein both the top, free end and the bottom, free end include a bend that forms a gap between the top, free end and the bottom, free end.

14. A clip assembly configured to retain a roll of paper towels on an object, said assembly comprising:

a tube having a top end and a bottom end, said tube being elongated;

a first disk coupled to said tube, said first disk being positioned proximate said bottom end of said tube;

a second disk removably coupled to said top end of said tube, the roll of paper towels being inserted onto said tube such that the roll of paper towels is retained between said first and second disks;

a clamp coupled to said bottom end of said tube, said clamp selectively engaging the object such that said tube is retained on the object;

wherein said second disk having an exterior edge extending between an upper side and a lower side of said second disk; a cap coupled to said upper side of said second disk; said top end of said tube extending through said lower and upper sides of said disk and engaging said cap; wherein a mount having a pair of ends; said mount being curved such that each of said pair of ends of said mount is positioned adjacent to one another; said mount forming an open loop; said mount being positionable around said tube proximate said bottom end of said tube.

15. The assembly according to claim 14, wherein said first disk having an outer edge extending between a top side and a bottom side of said disk; said bottom end of said tube extending through said top and bottom sides of said first disk.

16. The assembly according to claim 14, wherein a swivel having a first end and a second end; a ball coupled to said first end of said swivel; said ball being positioned between each of a pair of opposite ends of a mount such that said swivel is movably coupled to said mount; said clamp having a coupled end and a free end; said coupled end of said clamp being coupled to a second end of said swivel; said clamp being positionable at a selected angle with respect to said tube.

17. The assembly according to claim 16, wherein the free end of the clamp is further defined with a top, free end and a bottom, free end; wherein the top, free end extends away from the bottom, free end in order for the object to slide there between; wherein the top, free end and the bottom, free end are secured to one another via corner plates provided therein; wherein a wing nut and bolt is used to tighten the top, free end to the bottom, free end; wherein both the top, free end and the bottom, free end include a bend that forms a gap between the top, free end and the bottom, free end.

* * * * *